US007545261B1

(12) United States Patent
Harrington

(10) Patent No.: US 7,545,261 B1
(45) Date of Patent: Jun. 9, 2009

(54) PASSIVE METHOD AND APPARATUS FOR ALERTING A DRIVER OF A VEHICLE OF A POTENTIAL COLLISION CONDITION

(75) Inventor: Nathan J Harrington, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/202,948

(22) Filed: Sep. 2, 2008

(51) Int. Cl.
*G08G 1/16* (2006.01)
*G06G 7/78* (2006.01)

(52) U.S. Cl. ..... 340/435; 340/436; 340/902; 340/903; 340/904; 340/995.1; 342/457; 342/458; 701/207; 701/300; 701/301

(58) Field of Classification Search ..... 340/435, 340/436, 901–904, 906, 961; 342/454, 455, 342/457, 458; 701/45, 93, 96, 300, 301
See application file for complete search history.

(56) References Cited

U.S. PATENT DOCUMENTS

| | | | | |
|---|---|---|---|---|
| 5,249,157 | A | 9/1993 | Taylor | |
| 6,529,831 | B1 * | 3/2003 | Smith et al. | 701/301 |
| 6,690,291 | B1 | 2/2004 | Cardillo et al. | |
| 6,958,707 | B1 * | 10/2005 | Siegel | 340/902 |
| 6,967,592 | B2 | 11/2005 | Bell et al. | |
| 7,136,011 | B2 | 11/2006 | Mork et al. | |
| 7,302,325 | B2 | 11/2007 | Kudo | |
| 2003/0016143 | A1 | 1/2003 | Ghazarian | |
| 2004/0145496 | A1 | 7/2004 | Ellis | |
| 2007/0043502 | A1 * | 2/2007 | Mudalige et al. | 701/207 |
| 2007/0152803 | A1 | 7/2007 | Huang et al. | |

OTHER PUBLICATIONS

Arlen, G., "Smart Cars Hitting the Roads?" Newsbytes, SWSB00222013, Aug. 9, 2000.
Crosse, J., "Group Therapy," ITS Int'l., vol. 13, No. 5, pp. 60-61, Sep. 2007.
Dizikes, P., "Wireless Highway: Networked-Car Safety Research Hits the Road," Technology Review, 109, 2, 25 (2), Mar.-Apr. 2006.
"See It, Hear It, Feel It: Ford Seeks Most Effective Driver Warnings for Active Safety Technology," PR Newswire, Apr. 17, 2008.
Smelcer, K., et al., "Method for Optimizing Traffic Patterns Based on Broadcast Vehicle Location Information PF2119NA," Motorola, Inc. Technical Disclosure, IP.com Prior Art Database, Apr. 26, 2001, IPCOM000004745D.

(Continued)

*Primary Examiner*—George Bugg
*Assistant Examiner*—Anne V Lai
(74) *Attorney, Agent, or Firm*—Patents On Demand, PA; Brian K. Buchheit

(57) ABSTRACT

The present invention discloses a vehicular collision alert system (100) which receives signals (104) from devices (102) commonly associated with vehicular use. The direction (308) of the received signals is determined, and a heading of the signal source is also determined (610) and compared with the present location and heading of the vehicle (612). If the comparison indicates a sufficient chance of a collision, and alert is generated (616) to notify the driver of the vehicle of the potential collision.

3 Claims, 5 Drawing Sheets

OTHER PUBLICATIONS

"System and Method for Dynamically Predicting Traffic Violations and Increasing Safety," IBM Corp. Technical Disclosure Bulletin, IP.com Prior Art Database, Aug. 3, 2007, IPCOM000156769D.

Anonymous, "The Cooperative Intersection Collision Avoidance System for Crossing Path Violations," IP.com Prior Art Database, Aug. 4, 2008, IPCOM000173388D.

Johnson, R. C., "Bot-Mobiles Rev for City Traffic," Electronic Engineering Times, 1464, 20, Feb. 26, 2007.

Katayama, T., et al., "Traffic Accidents in Rural Area and Assistance System for Traffic Safety," US Dept. of Transportation, NHTSA, Proc. of 17th Int'l. Tech. Conf. on Enhanced Safety of Vehicles, DOT HS 809220, p. 5p, Jun. 4-7, 2001.

Marsh, D., "Radar Reflects Safer Highways: Radio Techniques Can Do More Than Just Alert You to an Accident On the Road Ahead," EDN, 48, 9, 51 (6), Apr. 24, 2003.

Murray, C.J., "Intelligent Vehicle Initiative Hits Fast Track In Bid to Cut Traffic Fatalities—Smart Techs Steer Toward Safer Cars," Electronic Engineering Times, 1, Jul. 24, 2000.

Suzuki, H., et al., "Performance of Inter-Vehicle Communication Technique for Intersection Collision Warning," 2005 5th Int'l. Conf. on Information, Communications and Signal Processing, Art. 1689118, Dec. 1, 2005.

Ueki, J., et al., "Development of Vehicular-Collision Avoidance Support System by Inter-vehicle Communications-VCASS," 2004 IEEE 59th Vehicular Tech. Conf., VTC2004-Spring; Towards a Global Wireless World, May 17-19, 2004.

* cited by examiner

PASSIVE METHOD AND APPARATUS FOR ALERTING A DRIVER OF A VEHICLE OF A POTENTIAL COLLISION CONDITION

BACKGROUND OF THE INVENTION

The present invention relates to the field of vehicular control systems, and more particularly to means of alerting the driver of a vehicle of a potential collision situation using passive techniques.

Interest in vehicular collision avoidance systems has been gaining recently, and some manufactures have begun offering collision warning systems in their vehicles. Such systems can be categorized as active, semi-active, and passive systems. Active systems involve inter-vehicular communications where vehicle systems in different vehicles communicate with each other, indicating their present location, speed, heading, and so on. These systems operate as an ad hoc network with a short or medium radio range. These systems are fairly complex and expensive, and do not provide information regarding vehicles which are not equipped with such equipment. Semi-active systems use active sensors such as short range radar, laser, or ultrasound detection to detect vehicles nearby. Signals are transmitted from the vehicle, and receivers detect reflections of the signals to determine distance and movement of surrounding objects. These systems are also fairly sophisticated and expensive. An example of a passive system is an optical detection system, which uses a camera to monitor areas around the vehicle, detect patterns corresponding to other vehicles, and determine distances and possible collision conditions. However, in inclement weather, optical systems have limited capabilities. Therefore there is a need for a relatively inexpensive alternative that is capable of detecting some collision situations and alerting drivers of a potential collision.

BRIEF SUMMARY OF THE INVENTION

The invention provide in one embodiment a vehicular system for cautioning a driver of a vehicle of a possible collision situation, and includes a radio receiving unit coupled to a directional antenna array mounted on the vehicle. The antenna array is configured to receive radio signals produced by devices associated with vehicular use and facilitates determining a direction of a source of the received signals. The vehicular system further includes a navigational system configured to determine a present location and heading of the vehicle, which provides information to a collision prediction system. the collision prediction system is coupled to the radio receiving unit and the navigational system, and is configured to compare the direction and a heading of the source of received signals with the location and heading of the vehicle, as provided by the navigational system, and provide an alert at a user interface of the vehicle if the comparison indicates a potential collision.

The invention further provides in another embodiment a method of alerting a driver of a vehicle of a potential collision, commenced by detecting a radio signal produced by a device associated with vehicular use. The method then proceeds by determining a direction and heading of the device based on the radio signal, and determining a location and heading of the vehicle as indicated by a navigational system of the vehicle. A collision prediction computer compares the direction and heading of the device with the location and heading of the vehicle, and alerts the driver of the vehicle if the direction and heading of the device and the location and heading of the vehicle indicates a potential collision.

In another embodiment of the invention, a computer program product embodied in a machine readable storage medium containing code is provided, which, when the code is executed, configures a vehicle collision alert system to detect a radio signal produced by a device associated with vehicular use. Further the vehicular collision alert system will determine a direction and heading of the device based on the radio signal, and determine a location and heading of the vehicle, as indicated by a navigational system of the vehicle. The code also causes the collision alert system to compare the direction and heading of the device with the location and heading of the vehicle, and alert the driver of the vehicle if comparing the direction and heading of the device with the location and heading of the vehicle indicates a potential collision.

DETAILED DESCRIPTION OF THE INVENTION

Figure 1:
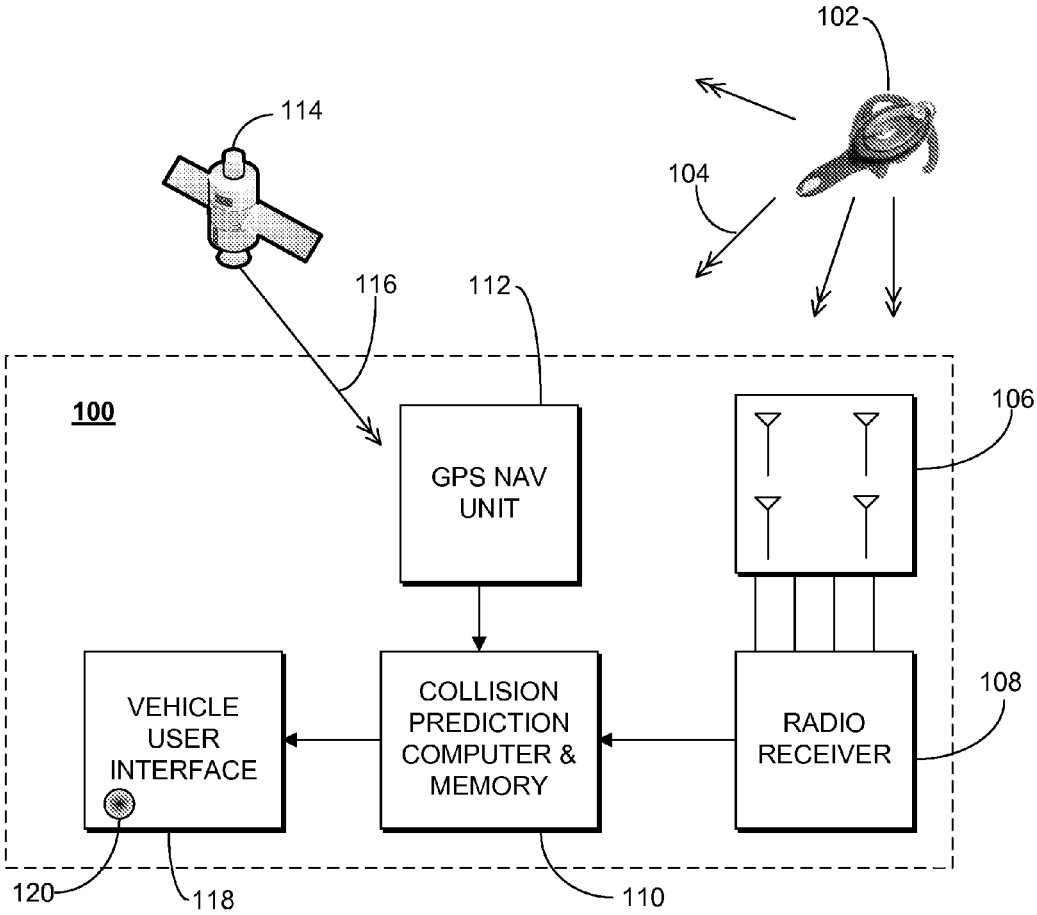
FIG. 1 is a block schematic diagram of a vehicular system for cautioning a driver of a possible collision with another vehicle, in accordance with an embodiment of the invention.

The present invention discloses a solution for passively determining a potential collision with another vehicle More specifically, the invention includes a directional antenna or antenna array elements and a radio receiver which can receive signals often associated with vehicular use, such as signals transmitted by "handsfree" cellular telephone accessories often used in vehicle. The directional antenna is used to determine a bearing and speed of the source of such signals. A vehicular navigational system supplies the vehicles present direction and speed, and may further provide mapping information. A computer system compares the vehicle speed and direction with that determined for the signal source, and determines whether a collision is likely. Upon finding a sufficient likelihood of a collision, the system provides an alert to the driver of the vehicle as to the possible collision. The driver then may take appropriate action.

As will be appreciated by one skilled in the art, the present invention may be embodied as a method, system, or computer program product. Accordingly, the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present invention may take the form of a computer program product on a computer-usable storage medium having computer-usable program code embodied in the medium. In a preferred embodiment, the invention is implemented in software, which includes but is not limited to firmware, resident software, microcode, etc.

Furthermore, the invention can take the form of a computer program product accessible from a computer-usable or computer-readable medium providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to the Internet, wireline, optical fiber cable, RF, etc.

Any suitable computer usable or computer readable medium may be utilized. The computer-usable or computer-readable medium may be, for example but not limited to, an electronic, magnetic, optical, electromagnetic, infrared, or semiconductor system, apparatus, device, or propagation medium. Examples of a computer-readable medium include a semiconductor or solid state memory, magnetic tape, a removable computer diskette, a random access memory (RAM), a read-only memory (ROM), an erasable programmable read-only memory (EPROM or Flash memory, a rigid magnetic disk and an optical disk. Current examples of optical disks include compact disk—read only memory (CD-ROM), compact disk-read/write (CD-R/W) and DVD. Other computer-readable medium can include a transmission media, such as those supporting the Internet, an intranet, a personal area network (PAN), or a magnetic storage device. Transmission media can include an electrical connection having one or more wires, an optical fiber, an optical storage device, and a defined segment of the electromagnet spectrum through which digitally encoded content is wirelessly conveyed using a carrier wave.

Note that the computer-usable or computer-readable medium can even include paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Computer program code for carrying out operations of the present invention may be written in an object oriented programming language such as Java, Smalltalk, C++ or the like. However, the computer program code for carrying out operations of the present invention may also be written in conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through a local area network (LAN) or a wide area network (WAN), or the connection may be made to an external computer (for example, through the Internet using an Internet Service Provider).

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The present invention is described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

FIG. 1 is a block schematic diagram of a vehicular system 100 for cautioning a driver of a possible collision with another vehicle, in accordance with an embodiment of the invention. The vehicle system 100 is disposed in a vehicle, and used to alert a driver of a potential collision with another vehicle. The vehicular system functions by receiving radio signals of the type commonly used in association with vehicle operation, which is referred to herein as devices associated with vehicular use. These devices can be portable electronic devices used by vehicle occupants, which have a primary function unrelated to collision detection/avoidance. For example, a hands-free earpiece 102 may be used to link with a cellular telephone while driving so that the driver does not have to hold the cell phone up to the driver's ear. These devices are used for convenience, although in many areas laws have been enacted requiring their usage over holding a cell phone to one's ear while driving. These devices typically use a low power radio link such as that described by the IEEE specification 802.15.1 specification for personal area networks, known commonly as the "Bluetooth" specification. Accordingly, these devices emit radio signals 104 which may be detected by other receivers. Other radio signals may be used by the vehicular system as well, including cell phone transmissions, wireless local area network signals, and so on. Devices 102 can include, but are not limited to, any RF transmission device, such as a notebook computer (transmitting using a WIFI network interface card), a mobile phone, a portable entertainment system, a media player, a navigation device, a personal data assistant, a walkie-talkie, a BLUETOOTH keyboard, and the like. The signals 104 from devices 102 have particular characteristics which facilitates detection, such as the frequency band they occupy, the modulation techniques used to communicate information, and so on. The vehicular system 100 uses a directional antenna 106 to receive radio signals. The directional antenna may use a plurality of antenna elements, each which receives radio signals. In one embodiment, the timing of signals received at each of the antenna elements may be used to determine a direction of the source of the signal. In an alternative embodiment, specially focused antenna element may be used to collect signals from different directions, with some overlap among the antenna elements, and the power level of signals received at these antenna elements can be used to infer a direction of the source of the signal. In another embodiment, a rotating antenna element may be used, and as the antenna is rotated the signal strength of received signals maybe used to infer a signal source direction.

To process signals received at the directional antenna 106 a radio receiver 108 is used. Preferably the radio receiver receives input separately from each antenna element making up the directional antenna. The radio receiver is capable of determining the frequency, bandwidth, and modulation used, if any, of signals received, as well as a signal strength. The receiver is particularly configured to receive signals associated with common radio devices which may be used in association with vehicle operation, such as, for example, Bluetooth devices. Accordingly, the receiver may be more sensitive than that required by devices operating according to such specifications because the receiver may need to receive the signals from a distance greater than the specified operating range of the device. Information is produced regarding received signals which may be used to determine signal source direction, as well as separate signals to determine the direction of multiple signal sources when more than one signal is being received. Furthermore, the receiver allows tracking of the signal characteristics over time, which allows further information to be determined, such as the direction of movement of the signal source(s) by determining the change of direction over time as well as the change in signal strength over time. The signal information produced by the receiver may be stored in a computational unit, such as a collision prediction computer 110 which includes memory.

The collision prediction computer analyzes the signal information provided by the radio receiver to calculate the approximate location, relative to the vehicle, of the signal sources of signals being received. As information is produced over time, the computer can track various signals and determine changes in direction over time. The collision prediction computer also receives information about the vehicle's present location and heading from a vehicle navigation unit, such as a satellite positioning navigational unit 112. The satellite positioning navigational unit receives signals 116 from positioning satellites 114, such as those used by the Global Positioning System (GPS), and map the GPS coordinates onto maps or map data stored in the navigational unit. The maps contain information regarding roadways, and navigational unit generates a map of the region around the vehicle as indicated by the positioning coordinates, and then displays the map on a graphical display, allowing the user to see where the vehicle is located, what roads are ahead, and so on. Many navigational units contain "points of interest" such as the locations of fuel stations, restaurants, and hotels, and will chart routes to destinations. Thus, in addition to the present location and heading of the vehicle, the navigational unit can also provide map data to the collision prediction computer.

As information about the vehicles present position continues to be received, the collision prediction computer 110 can compare the present vehicle location and heading (i.e. orientation and speed) with that of signal sources. However, determining the location of a signal source can be difficult due to a variety of variables, such as, for example, received signal strength. Although common radio devices may operate at specified transmission power levels, the strength of the received signal may be affected by things such as whether the vehicle in which the device is located has its windows up or down (open). The windows can attenuate signals by a significant amount, thereby making it difficult to determine how far away the signal source is based solely on received signal strength, despite knowing the specified transmission power for a given device. Furthermore, multi-path effects can cause some uncertainty in both signal direction and signal strength. However, given that the navigational unit can provide map information, including roadway locations, the collision prediction computer can assume that the signal source is operating on a roadway in the direction of the received signal, and map the signal source to a known roadway location in the indicated direction. Over time, the change in direction of a signal source from the vehicle can be further used to refine this mapping. In some cases it may appear that the signal source is not changing location, or that its change of location does not correspond with a known roadway, and these signal sources may be dismissed as a collision threat. However, when the predicted path of the vehicle and that of tracked signal sources intersect such that there is a sufficient likelihood of a collision, the collision prediction computer issues an alert to the vehicle user interface 118, resulting in a perceptible alert 120 being generated to inform the driver of a potential collision situation. The alert may be a visible or audible alert, or both.

Figure 2:
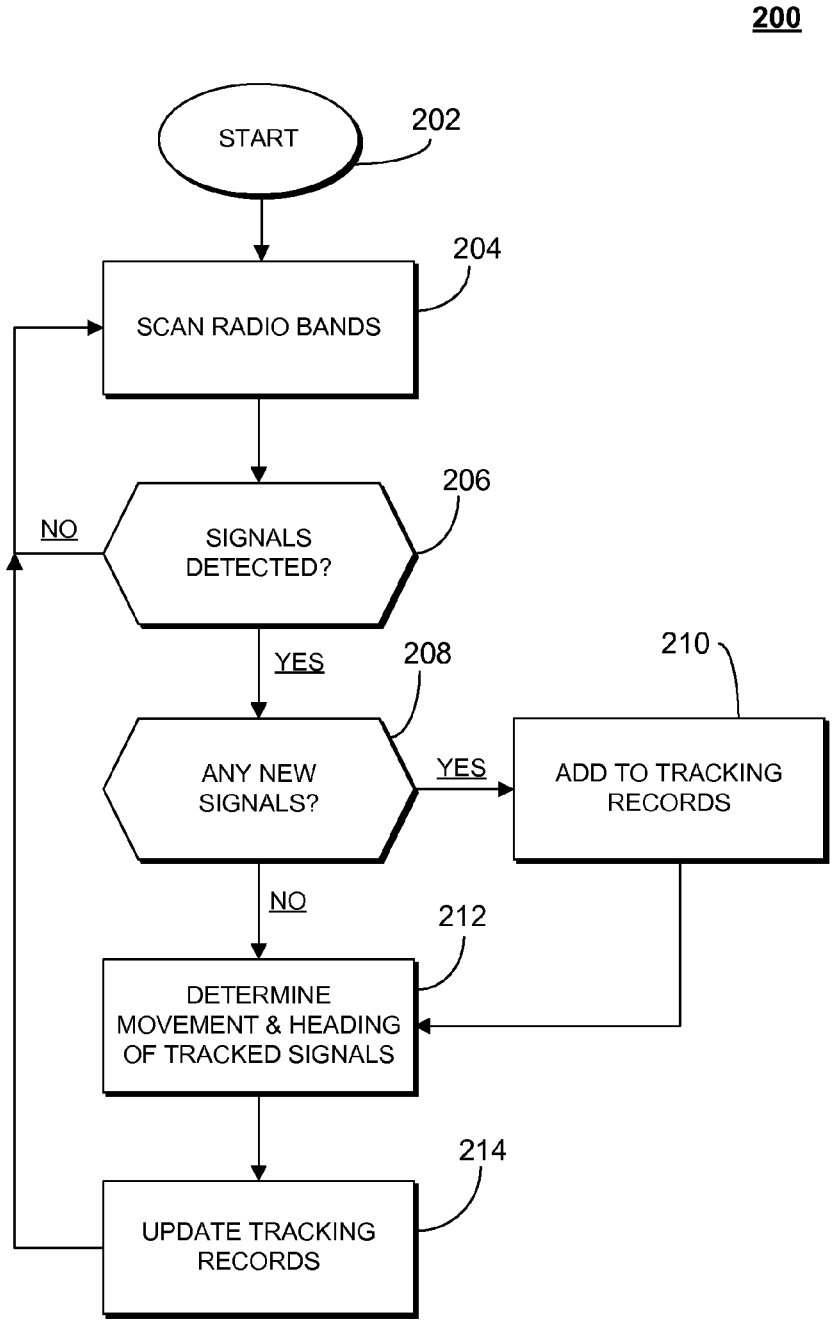
FIG. 2 shows a flow chart diagram of a method of tracking detected signal sources for use in a vehicular system, in accordance with an embodiment of the invention.

FIG. 2 shows a flow chart diagram 200 of a method detecting and tracking signal sources, in accordance with an embodiment of the invention. At the start 202 the vehicular system may be tracking one or more signal sources based on received signals. The radio receiver scans (204) known radio bands on which various electronic devices operate and which are known to be used in association with vehicle operation. IF no signals are detected the method simple repeats until one or signals are detected (206). As signals are detected, the signal information may be used to determine if any new signal sources are being detected (208). If any new signal sources have been found, a tracking record is created, and new signal source is added to the other signal sources being tracked by the vehicular system. Based on received signal information, the movement and heading of signal sources may be determined (212). As used here, the heading is meant to refer to the orientation and speed of a signal source. Furthermore, mapping information provided by the navigational unit maybe used to determine a location of the signal source by mapping the direction of the signal source to a likely roadway. Subsequent information regarding changed in direction of the signal source may be used to confirm location of the signal source on the roadway. As the apparent location of signal sources change, tracking records may be updated (214). The tracking records are used to determine whether a collision is likely.

Figure 3:
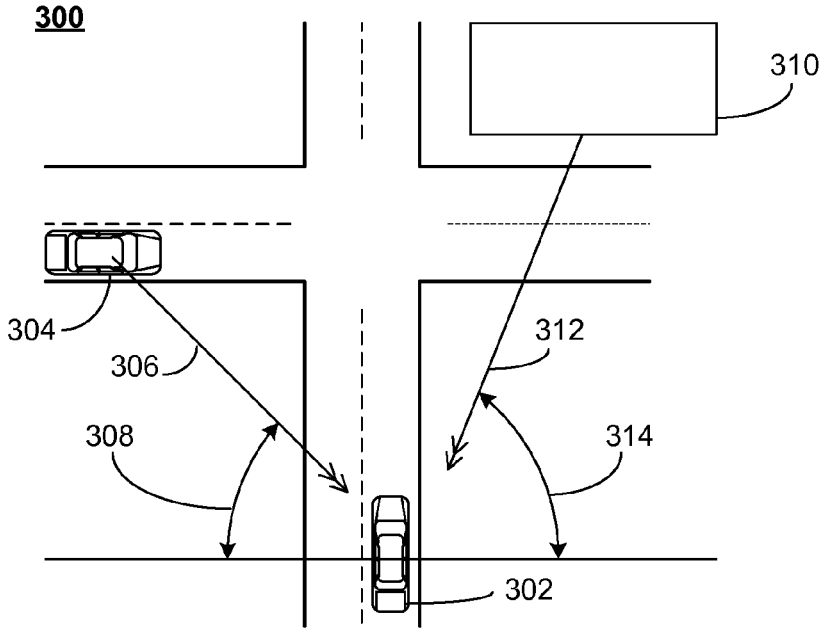
FIG. 3 shows a mapping diagram of tracking received signals for determining a possible collision, in accordance with an embodiment of the invention.
Figure 4:
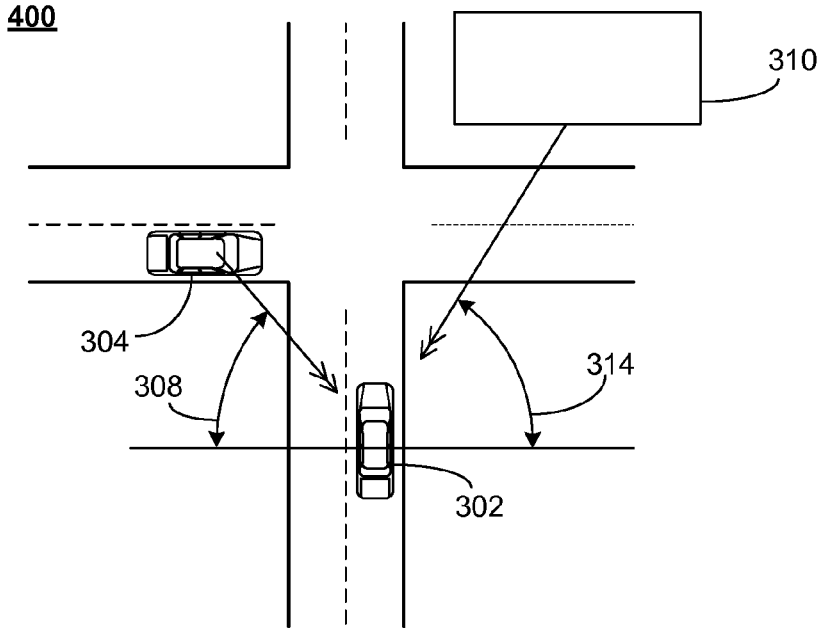
FIG. 4 shows a mapping diagram of tracking received signals for determining a possible collision, in accordance with an embodiment of the invention.

FIGS. 3 and 4 show mapping diagrams 300, 400, respectively, of tracking received signals for determining a possible collision, in accordance with an embodiment of the invention. A first vehicle 302 using the inventive vehicular system is shown proceeding along a first roadway. A second vehicle 304 using a radio device is traveling along a perpendicular roadway towards and intersection with the first roadway on which the first vehicle 302 is traveling. Signals 306 transmitted from the device in the second vehicle may be received at the first vehicle. An angle of arrival 308 may be determined with the directional antenna. Signal characteristics such as frequency, bandwidth, and modulation may be used to track the signal. As the vehicles move closer to the intersection, as shown in FIG. 4, the angle of arrival may not change much; however, the signal strength will change due to the vehicles getting closer. By subtracting the known movement of the first vehicle, the collision prediction computer can determine that the second vehicle is a potential collision risk, and alert the user. The collision prediction computer can also rule out signal sources as collision risks. For example, a building 310 contains a device which transmits radio signals 312 which are similar to those transmitted by devices used in operating vehicles. There are a variety of factors which may result in the signal source being ruled out as a collision risk. For example, the signal may be in a frequency band used by electronic devices in vehicles, but may have no modulation. That is, may be just a carrier wave, such as that used to detect the presence of movement to operate automatic doors. Additionally, as the first vehicle moves, the angle of arrival 314 and signal strength relative to the first vehicle's movement indicate the signal source, even if it is of the type commonly used in vehicles, is stationary, and thus not a collision risk.

Figure 5:
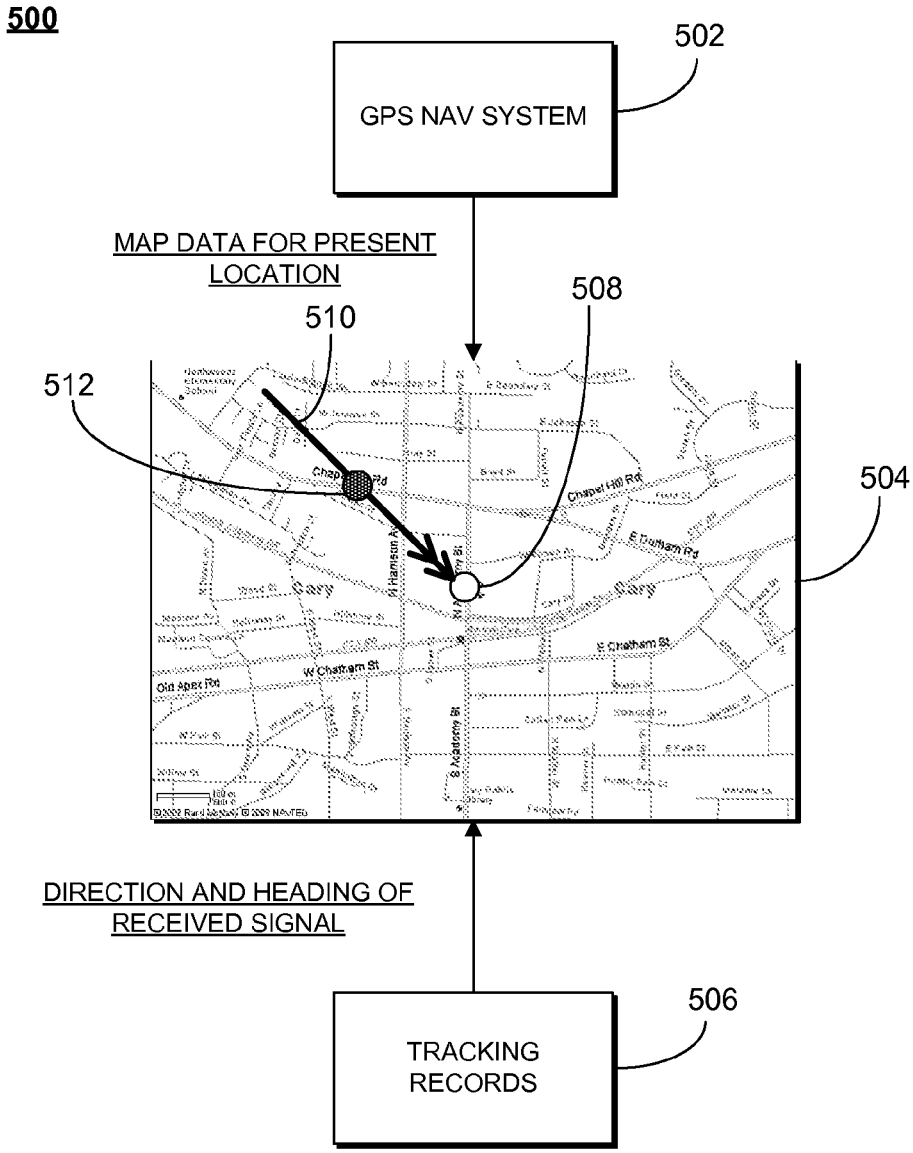
FIG. 5 shows a system function diagram for determining the location of a signal source based on a map of a region surround a vehicle, in accordance with an embodiment of the invention.

Referring now to FIG. 5, there is shown a system function diagram 500 for determining the location of a signal source based on a map of a region surround a vehicle, in accordance with an embodiment of the invention. A collision prediction computer may receive information from a vehicle navigation system 502 including map data for the present location of the vehicle 504. The collision prediction computer also receives tracking information 506 of known signal sources in the region around the vehicle, or at least in a region of interest. The navigation system may inform the collision prediction computer of the present location 508 of the vehicle relative to the map, and indicate it is traveling on a particular roadway. The tracking information may indicate that a signal is being received from the direction of arrow 510 from a signal source of the type commonly used in vehicles. Based on changes of signal direction and strength over time, the collision prediction computer may infer or assume that the signal source is on an intersecting roadway at location 512. If the vehicle and signal source move towards each other on the intersecting roadways, the collision prediction computer may issue an alert or caution signal indicating the presence of the other vehicle.

Figure 6:
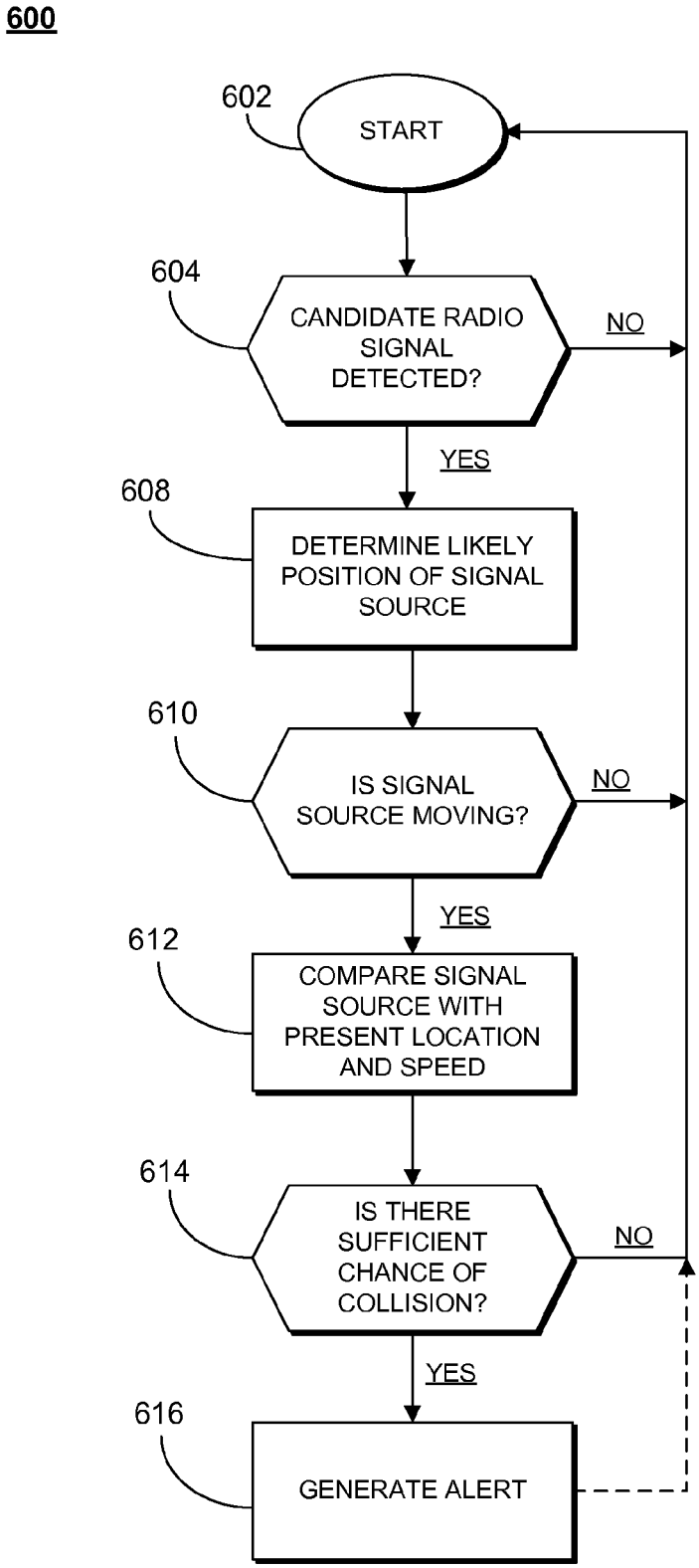
FIG. 6 shows a flow chart diagram of a method for cautioning a driver of a possible collision with another vehicle, in accordance with an embodiment of the invention.

FIG. 6 shows a flow chart diagram 600 of a method for cautioning a driver of a possible collision with another vehicle, in accordance with an embodiment of the invention. At the start 602, the vehicular system is ready to commence operation. The method proceeds by receiving radio signals at the directional antenna, and detecting candidate signals (604). Candidate signals conform to criteria indicative of certain electronic device used in correspondence with vehicle operation. Upon detecting one or more candidate signals, the direction of each candidate signal from relative to the vehicle is determined (608). Given the effects of radio signal propagation, the direction of the signal sources may be approximated to account for uncertainty. The method commences by determining if the signal received from a given signal source indicates the signal source is moving (610). If it does not appear the signal source is moving, then it is not a collision risk. If the signal source is moving, then the collision prediction computer compares the estimated or assumed signal location and heading with that of the vehicle (612). If the comparison indicates there is a sufficient likelihood of a collision (614), the collision prediction computer may issue one or more alerts, and may indicate a degree of certainty as well (616).

The method is repetitive and continues until shut off. The method described here is an exemplary method. Those skilled in the art will realize there are numerous modifications that may be made without departing from the spirit and scope of the invention described herein. For example, various fault tolerance may be designed into the system to account, for example, for rapid changes in signal characteristics. For example, the user of a device in another vehicle may close a window, thereby attenuating the signal, and reducing the signal strength at the receiver. Furthermore, it will be appreciated by those skilled in the art that the invention methods described here may be implement by machine readable code, which may be stored is a machine readable medium. When the code is executed by a properly configured computing system, the system will perfume as described.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A vehicular system for cautioning a driver of a vehicle of a possible collision situation, comprising:

a radio receiving unit coupled to a directional antenna array mounted on a receiving vehicle, and configured to receive radio signals produced by devices associated with vehicular use within a transmitting vehicle and having an effective range corresponding to a potential collision proximity, wherein the directional antenna array facilitates determining a direction of a source of the received signals;

a navigational system configured to determine a present location and heading of the receiving vehicle;

a collision prediction system coupled to the radio receiving unit and the navigational system, and configured to compare the direction of the transmitting vehicle with the location and heading of the receiving vehicle provided by the navigational system and provide an alert at a user interface of the receiving vehicle if the comparison indicates a potential collision; and wherein the devices associated with vehicular use comprise at least one of a handsfree earpiece, and a portable computing device producing wireless local area network signals.

2. A vehicular system as defined by claim 1, wherein the collision prediction system uses map information provided by the navigational system to determine a likely location of the transmitting vehicle.

3. A vehicular system as defined by claim 2, wherein the collision prediction system locates a road indicated on the map in the direction of the transmitting vehicle and assumes the transmitting vehicle is traveling on the road.

* * * * *